United States Patent [19]

Buchanan et al.

[11] Patent Number: 4,994,172

[45] Date of Patent: Feb. 19, 1991

[54] PIPELINEABLE SYNCRUDE (SYNTHETIC CRUDE) FROM HEAVY OIL

[75] Inventors: John S. Buchanan, Hamilton Square; Lillian A. Rankel, Princeton, both of N.J.; Tsoung-Yuan Yan, Philadelphia, Pa.

[73] Assignee: Mobil Oil Corporation, Fairfax, Va.

[21] Appl. No.: 375,068

[22] Filed: Jun. 30, 1989

[51] Int. Cl.[5] ..... C10G 9/00

[52] U.S. Cl. ..... 208/106; 208/96

[58] Field of Search ..... 208/86, 96, 106, 251 R, 208/309, 321, 337

[56] References Cited

U.S. PATENT DOCUMENTS

| | | | |
|---|---|---|---|
| 3,053,750 | 5/1960 | Beuther et al. | 208/96 X |
| 4,029,571 | 6/1977 | Curtin | 208/106 X |
| 4,200,519 | 4/1980 | Kwant et al. | 208/86 X |
| 4,290,880 | 9/1981 | Leonard | 208/309 |
| 4,334,976 | 6/1982 | Yan | 208/8 |
| 4,428,824 | 1/1984 | Choi et al. | 208/86 |
| 4,430,206 | 2/1984 | Rankel | 208/251 R |
| 4,454,023 | 6/1984 | Lutz | 208/106 X |
| 4,504,377 | 3/1985 | Shu et al. | 208/106 X |
| 4,522,703 | 6/1985 | Yan | 208/106 |
| 4,604,188 | 8/1986 | Yan et al. | 208/106 |
| 4,767,521 | 8/1988 | Feldman et al. | 208/88 X |
| 4,846,958 | 7/1989 | Feldman et al. | 208/96 X |

*Primary Examiner*—Curtis R. Davis
*Assistant Examiner*—William C. Diemler
*Attorney, Agent, or Firm*—Alexander McKillop; Charles J. Speciale; Richard D. Stone

[57] ABSTRACT

A process for preparing a pipelineable oil from a heavy crude oil by thermally treating the oil in the absence of added hydrogen, and under sufficiently severe conditions to induce the formation of an upgraded, low viscosity oil phase and a liquid asphalt phase that contains dispersed coke. The reaction is conducted under pressure sufficient to retain in the reactor most of the normally liquid hydrocarbons, under which conditions the two phases are readily separated and recovered solely by gravity settling. The process is readily adapted to oil field use with skid mounted units. The severity is adjusted to provide sufficient asphalt which, when burned, furnishes the steam required for production of the heavy crude oil.

9 Claims, 1 Drawing Sheet

PIPELINEABLE SYNCRUDE (SYNTHETIC CRUDE) FROM HEAVY OIL

FIELD OF THE INVENTION

This invention is concerned with manufacturing a pipelineable syncrude from heavy crude oil. This invention is also concerned with manufacturing a syncrude of improved quality from a heavy crude oil. This invention is further concerned with a process for making pipelineable syncrude from heavy oil, which process is adaptable to on-site use in a heavy oil field, and which is integrated with heavy oil production by supplying by-product fuel for such production.

BACKGROUND OF THE INVENTION

Extensive reserves of petroleum in the form of so-called "heavy crudes" exist in a number of countries, including Western Canada, Venezuela, Russia, the United States and elsewhere. Many of these reserves are located in relatively inaccessible geographic regions. The United Nations Institute For Training And Research (UNITAR) has defined heavy crudes as those having an API gravity of less than 20, suggesting a high content of polynuclear compounds and a relatively low hydrogen content. The term "heavy crude", whenever used in this specification, means a crude having an API gravity of less than 20. In addition to a high specific gravity, heavy crudes in general have other properties in common, including a high content of metals, nitrogen, sulfur and oxygen, and a high Conradson Carbon Residue (CCR). The heavy crudes generally are not fluid at ambient temperatures and do not meet local specifications for pipelineability. It has been proposed that such crudes resulted from microbial action which consumed alkanes, leaving behind the heavier, more complex structures which are now present.

A typical heavy crude oil is that recovered from the tar sands deposits in the Cold Lake region of Alberta in northwestern Canada. The composition and boiling range properties of a Cold Lake crude (as given by V. N. Venketesan and W. R. Shu, J. Canad. Petr. Tech., p66, July–August 1986) is shown in Table A. A topped Mexican heavy crude is included for comparison. The similarities are evident

TABLE A

Analysis of Maya 650° F. and Cold Lake Oil

| | Maya 650° F.+ | | Cold Lake (Lower Grand Rapids Primary Production) |
|---|---|---|---|
| % C | 84.0 | | 83.8 |
| H | 10.4 | | 10.3 |
| N | 0.06 | | 0.44 |
| O | 0.97 | | 0.81 |
| S | 4.7 | | 4.65 |
| CCR | 17.3 | | 12.3 |
| % $C_7$-Insoluble Asphaltenes | 18.5 | | 15.0 |
| Ni, ppm | 78 | | 74 |
| V, ppm | 372 | | 175 |
| CCR | 17.3 | | — |
| Boiling Range | | | |
| 75–400° F. | 0.62 | 75–400° F. | 1.3 |
| 400–800° F. | 21.7 | 400–650° F. | 15.2 |
| 800–1050° F. | 19.0 | 650–1000° F. | 29.7 |
| 1050° F.+ | 58.71 | 1000° F.+ | 53.8 |

TABLE B

| Temperature | Viscosity, cs (centistokes) |
|---|---|
| 2° C. (28° F.) | Solid |
| 38° C. (100° F.) | 4797 |
| 54° C. (130° F.) | 1137 |
| 100° C. (212° F.) | 82 |

Because of their poor flow properties, the heavy crudes are difficult to produce without assistance, such as steam injection or fire-flooding. Such adjuvants require thermal energy equivalent to 10 to about 30 wt% of the produced oil.

The heavy crudes play little or no role in present-day petroleum refineries. Two principal reasons for this are that they are not amenable to ordinary pipeline transportation, and that because of the high metals and CCR values, they are not readily converted to gasoline and/or distillate fuels without further processing. The progressive depletion and rising cost of high quality crudes, however, create a need for new technology which would inexpensively convert heavy crudes to pipelineable syncrudes, preferably with concomitant upgrading of quality, i.e. ease of conversion to the gasoline and/or distillate fuels which are in heavy demand. Such technology would augment the supply of available crude, and would make it possible for refiners to blend such syncrude with a more conventional feed for catalytic cracking and hydrocracking. The term "syncrude" as used herein means a synthetic crude oil that is a prepared by thermal and/or chemical conversion of a naturally occurring heavy crude oil or a similar substance.

A number of methods have been proposed for decreasing the viscosity of a heavy crude oil so as to improve its pumpability. These include diluting with a light hydrocarbon stream, transporting by heated pipeline, and using various processing options including visbreaking, coking and deasphalting. With most heavy crudes, conventional visbreaking or conventional deasphalting alone cannot give sufficient viscosity reduction. Attempts to reduce the viscosity to the required level by these routes usually lead to an incompatible two-phase product from visbreaking and to a very low yield of deasphalted syncrude from deasphalting.

Visbreaking and coking as practiced in petroleum refineries are conventional thermal processes. Visbreaking is a mild thermal cracking process in which the higher molecular weight components of the heavy oil are cracked to lighter products. Excessive severity in visbreaking is normally undesirable since secondary condensation reactions occur which form incompatible sludge that separates out of the visbroken effluent on dilution with conventional cutter stock. In coking, which is a severe thermal process, the heavy oil feed is heated to cracking temperatures and converted into solid coke and lower molecular weight products which are removed as a vapor. Various coking processes are known, including delayed coking, fluid coking and contact coking and of these, delayed coking is the most common.

Deasphalting by conventional solvent extraction lacks selectivity for many contaminants, resulting in a requirement for a high solvent to oil ratio. The capital cost and energy consumption to handle the solvent in each step of the process are high. The poor selectivity of solvent extraction leads to the production of a large volume of low value product (asphalt).

Mild thermal processing, such as visbreaking, requires relatively little equipment and relatively little in the way of process heat. Visbreaking reduces the viscosity of the product, but not the contaminant content, so the "upgrading" is limited to viscosity reduction. And, furthermore, viscosity reduction is usually not sufficient to achieve pipeline specifications if visbreaking severity is limited to the onset of instability. Visbreaking combined with deasphalting could upgrade the syncrude product but the process then acquires the disadvantages noted above for solvent extraction. More severe thermal processing techniques such as delayed coking are less advantageous. The capital and operating costs of delayed coking are high and the value of the coke product may be less than 1/10 that of the feed (for shot coke) or slightly more (for sponge coke) from low quality residua.

It is an object of this invention to prepare a pipelineable syncrude from a heavy crude oil by severe thermal processing with substantially no production of bulk solid coke. It is a further object of this invention to provide a simple process for preparing a pipelineable syncrude from a heavy crude oil, said process being readily adapted to on-site use and integratable with oil production in a heavy crude oil field. These and further objects will become evident on reading this entire specification including the appended claims.

BRIEF SUMMARY OF THE INVENTION

Figure 1:
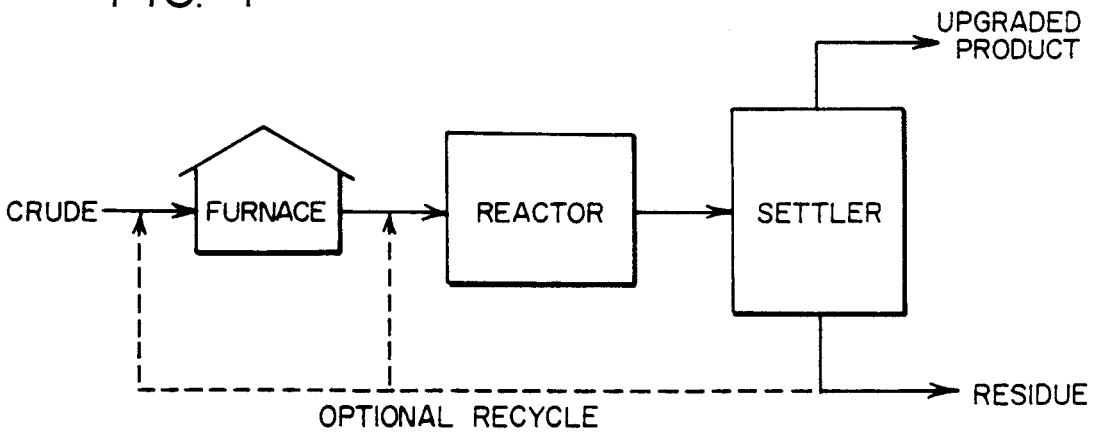
FIG. 1. Process configuration with separate reactor and settler.

The concept process described herein provides a process for preparing a pipelineable and substantially upgraded syncrude from a heavy crude oil characterized by an API gravity of less than 20°, and by a measurable nickel and vanadium content, said process comprising:

(a) thermally treating in a reactor in the absence of added hydrogen gas at least the 650° F.+ fraction of the heavy crude oil under conditions of outlet temperature, time and reactor outlet pressure such that said oil is subjected to an equivalent residence time (at 800° F.) of 2000 to about 20,000 ERT seconds whereby forming a separable liquid/liquid mixture of thermal syncrude and asphalt phases, said asphalt phase being characterized by a higher specific gravity than said syncrude phase;

(b) maintaining said mixture of thermal syncrude and asphalt phases in a settler under conditions effective to induce liquid/liquid separation solely by gravity of said syncrude phase and said asphalt phase, said conditions including a temperature of 150° to about 950° F. and a time of 0.05 to about 1.0 hours; and, (c) recovering said separate phases.

The advantages provided by this invention include simplicity and low cost, with minimal use of complex distillation or solvent recovery means. It is eminently suited to on-site processing of heavy crudes, and to integration with crude production by burning the low-value asphalt phase to supply steam required for the production of crude oil. To accomplish this integration, the severity of the thermal treatment is adjusted to yield the right proportion of asphaltic phase needed to generate the required steam.

Other embodiments will be described hereinbelow.

DETAILED DESCRIPTION, PREFERRED EMBODIMENTS AND BEST MODE

It is contemplated that any heavy crude oil may be used as feed to the process of this invention. Optionally, if desired, the heavy crude may be topped to remove materials boiling below 650° F. before thermally treating by the method of this invention. However, although it is not required for purposes of this invention to include material boiling below 650° F., it is necessary to include material contained in the crude which boils in the 650° to 975° F. range (i.e. the vacuum gas oil fraction) in order to effect separation of the phases by gravity. (Compare Examples 1-2, below.)

The thermal step used in the process of this invention may be regarded as a modification of the conventional visbreaking process which has been used for many years in petroleum refineries to treat vacuum resids, for example, in order to reduce the amount of cutter stock needed to produce from such oils merchant heavy fuel oil meeting viscosity specifications.

Visbreaking, like thermal cracking, is kinetically a firstorder reaction. The severity of visbreaking is often expressed as ERT (equivalent residence time at 800° F. in seconds), calculated by multiplying the cold oil residence time above 800° F. by the ratio of relative reaction velocities as defined by Nelson (W.L. Nelson, Petroleum Refinery Engineering, 4th Ed., FIG. 19-18, page 675) taking into consideration the temperature profile across the visbreaker coil, using the average temperature for each one foot segment of the coil above 800° F. As the severity increases, excess cracking leads to coil fouling and instability. The maximum visbreaking severity varies for different crudes, but typically it is below about 700 ERT seconds. All references made herein to severity in terms of ERT or ERT seconds are intended to mean the equivalent severity at 800° F. in seconds, regardless of the actual temperature or temperatures used, calculated as described above or by a mathematically equivalent method.

The thermal treatment of the present invention is distinguished from conventional visbreaking by the use of severities much greater than 700 ERT seconds, and by the maintenance of sufficient pressure to retain substantially all of the normally liquid cracked products in the reactor and settler for a time long enough to induce the desired conversion and liquid/liquid phase separation. These phases are separated readily to recover the desired high quality syncrude product and the low quality asphaltic phase to be used as fuel.

Conventional visbreaking is conducted at a temperature of about 800° to 900° F. The allowable reaction time at 800° F. in conventional visbreaking is generally less than 700 ERT seconds (11.7 minutes), since at greater severity, secondary condensation and polymerization reactions result in the formation of incompatible sediment which is not tolerable in merchant heavy fuel oil. In the process of the present invention, however, severities up to about 20,000 ERT seconds or more are contemplated to create such conventionally undesirable phase separation for the purpose of separating the products into high quality syncrude and low quality asphaltic fuel products. Thus, the process of this invention may be considered a liquid-phase coking process that does not produce bulk, solid coke. The thermal treatment of the present invention may produce toluene (and tetrahydrofuran) insoluble material, however, which becomes associated with the asphalt phase preferentially. For purposes of the present invention, the term "coke" means a reaction product insoluble in tetrahydrofuran.

For purposes of the present invention, the thermal step is conducted under the conditions shown in Table C.

TABLE C

| | Temperature, °F. | Time, Hrs. | Pressure, psig |
|---|---|---|---|
| Broad | 750°-950° | 0.1-3.0 | 50-2000 |
| Preferred | 750°-850° | 0.5-1.0 | 100-800 |

However, not all the combinations of temperature and time shown in Table C are effective, there being the additional constraint that the severity of the thermal step be within the range of about 1000 to about 20,000 ERT seconds, but preferably within the range of about 2000 to 20,000 ERT seconds, and most preferably in the range of 2000 to 10,000 ERT seconds. For any particular feed, the workable window of ERT range is contemplated to be quite narrow. In any case, the lower limit of the severity should be at least that which is effective to cause the necessary phase separation.

After completion of the thermal step, the phases are separated by gravity. It is a feature of this invention that the major separation step, and in many instances the only separation, is readily achieved by such simple means as gravity settling. This step is facilitated by adjusting the severity of the thermal cracking and maintaining the settler at an optimum temperature for liquid/liquid separation, which is readily determined by a few trial tests. In general, the ease and sharpness of the separation are favored by increased severity, which decreases the compatibilty of the asphalt phase while increasing the antisolvent effect of the lighter cracked products. It is contemplated that the onset of ease of separation will generally be observed when the thermal treatment is sufficiently severe to form at least 3 wt% coke based on the total liquid product. The relative amounts of the upper and lower phases produced from a given crude are adjusted primarily by varying the severity in the thermal step, but some further control is also achieved by control of temperature and flow rates in the settler. The desired amounts of the two phases depend on various technical and economic factors. In a particularly preferred embodiment, conditions are adjusted such that the amount of asphalt phase produced closely matches the amount of fuel required for production in nearby oilproducing areas.

Figure 2:
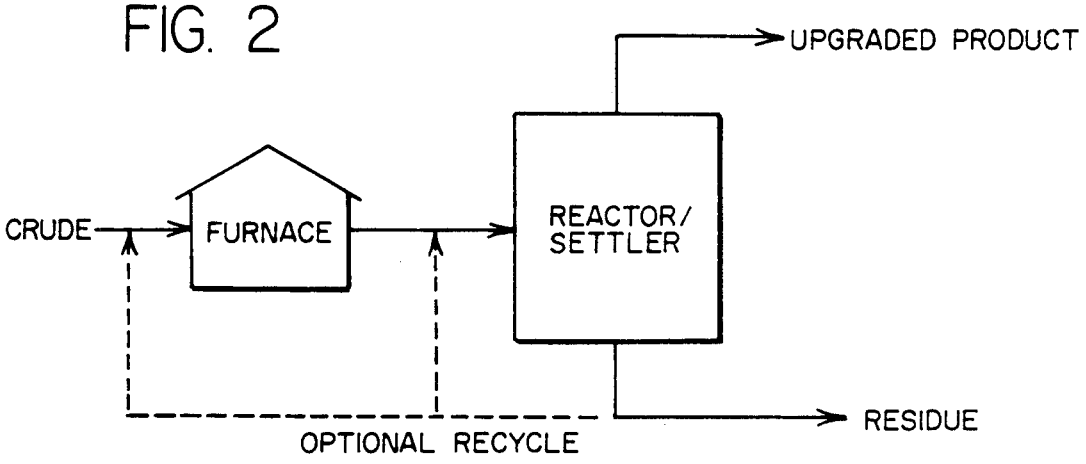
FIG. 2. Process configuration with combined reactor/ settler.

The equipment required for the process of this invention is conventional and need not be described here in any detail. FIG. 1 and FIG. 2 of the drawing illustrate two embodiments. In either one, the feed is heated in a furnace by passing it rapidly through a short length of coil, optionally with addition of some steam. The heated oil is then passed in FIG. 1 to a reactor where it is retained for the requisite time, and it is then passed to a settler. Upgraded light oil is removed as upflow product, and the asphaltic by-product is removed as downflow product. FIG. 2 illustrates the use of a single vessel to serve as both reactor and settler. Outlet pressure of the reactor and settler (FIG. 1) or of the combined unit (FIG. 2) are maintained by back-pressure valves (not shown).

Thermal cracking by the process of this invention forms a denser, asphaltic product with dispersed coke, metals and sulfur, and a relatively light liquid product phase with a substantially reduced level of contaminants. The light liquid product may be used as a feed for an FCC unit or as a low sulfur fuel.

EXAMPLES

The following examples are given to illustrate this invention, but they are not to be construed as limiting the scope thereof, which scope is determined by this entire specification and the appended claims.

The starting material for Examples 1-4 was the 650° F.+0 fraction of Maya crude (Maya atmospheric resid). This fraction represents 65.7 wt% of the whole crude.

All of the visbreaking runs reported below were done in a 300 cc stirred autoclave using about 100 g of the Maya resid. The procedure was to change the heavy crude to the autoclave which was then heated and held at the desired temperature for the time required to achieve desired ERT severity. At that time the autoclave was quenched with ice water and brought to room temperature within a few minutes.

EXAMPLE 1

In this example, 100.9 g of the Maya resid was placed in the stirred autoclave, which was sealed and heated to 750° F. and held at that temperature for 120 minutes. The pressure which built up was held to 500 psig by a back-pressure regulator. At the end of the 120 minutes, the stirrer was stopped and the autoclave was quenched with ice water and brought to room temperature within 5 minutes. During the run, 7.4 g of material left the autoclave as gas, of which 0.4 g condensed in a cold trap. The treatment severity was calculated to be 2300 ERT seconds.

The liquid upper layer was decanted from the lower layer at room temperature; 69.17 g of liquid was recovered. Its viscosity, although not measured, was estimated to be less than about 50 cps at room temperature.

The decanted liquid was centrifuged at 500 rpm for 30 minutes, and 28.0 g of material settled out. The centrifuged liquid yield at this point corresponded to 41.2 g. This final decant oil analyzed 13 ppm Ni, 112 ppm V, 10.8% CCR and 3.5 wt% S. (The centrifuge sediment was combined with the autoclave residue for further analyses.) This final decanted oil was 72% demetallated (125 ppm Ni+V), 37% deCCR (10.8% CCR), and contained 19% 1050° F.+ material compared to the room temperature solid feed that had 450 ppm Ni+V, 17.2% CCR, and 59% 1050° F.+ material.

The decanted, centrifuged oil and the residue were subject to analysis for coke (residue after tetrahydrofuran extraction), asphaltenes (n-$C_7$ insoluble), and boiling point distribution. The results are summarized in Table I.

TABLE I

| | CENTRIFUGED DECANTED OIL | | NON-DECANTED BOTTOMS | | TOTAL $C_4$+ | |
|---|---|---|---|---|---|---|
| | Gms. | Wt. % | Gms. | Wt. % | Gms. | Wt. % |
| $C_4$-75 | 6.96 | 6.90 | 0 | 0 | 6.96 | 6.90 |
| 75-400 | 2.68 | 2.66 | 1.17 | 1.16 | 3.85 | 3.82 |
| 400-800 | 19.64 | 19.46 | 19.23 | 19.06 | 38.87 | 38.52 |
| 800-1050 | 10.06 | 9.97 | 8.91 | 8.82 | 18.97 | 18.79 |
| +1050 | 6.49 | 6.43 | 7.03 | 6.97 | 13.52 | 13.40 |
| $C_7$ Insol. | 2.74 | 2.72 | 10.25 | 10.16 | 12.99 | 12.88 |
| Coke | 0 | 0 | 5.74 | 5.69 | 5.74 | 5.69 |
| TOTAL | 48.57 | 48.14 | 52.33 | 51.86 | 100.90 | 100.00 |

EXAMPLE 2–4

In each of these examples the 650° F.+ Maya resid was treated as in Example 1, but the treatment temperature was 850° F. in all three examples, and the time of treatment was as follows:

| | Time, min. | ERT (sec.) |
|---|---|---|
| Example 2 | 30 | 8,300 |
| Example 3 | 60 | 16,300 |
| Example 4 | 120 | 32,300 |

The total product was analyzed for coke (tetrahydrofuran insolubles), asphaltenes (n-$C_7$ insol.) and boiling range distribution. The results are summarized in Table II.

TABLE II

| | Examples | | |
|---|---|---|---|
| | 2 | 3 | 4 |
| Severity, ERT sec. | 8,300 | 16,300 | 32,300 |
| Prod. Dist., wt % | | | |
| Gas - 75° F. | 13.53 | 11.67 | 16.27 |
| 75°–400° F. | 25.11 | 29.71 | 31.10 |
| 400°–800° F. | 25.13 | 20.29 | 11.25 |
| 800°–1050° F. | 5.18 | 3.35 | 1.18 |
| 1050° F.+ oil | 4.63 | 3.04 | 1.43 |
| Asphaltenes (n-C7) | 10.75 | 7.27 | 4.04 |
| Coke (THF insol.) | 15.66 | 24.67 | 34.72 |

EXAMPLE 5

A Maya 975° F.+ (vacuum resid, 35.7 wt% of the whole crude) was processed under the same conditions of thermal treatment/decanting as described in Example 1, but no oil could be poured from the autoclave. Product separation could be achieved only with the addition of solvent. It appears that the 650°–975° F. boiling range fraction must be present with the vacuum resid for sufficient total viscosity reduction to occur during the thermal treatment to allow separation by gravity.

This example is not considered within the scope of the present invention because the thermally processed material did not include "at least the 650° F.+ fraction" of the heavy crude.

What is claimed is:

1. In an integrated process for producing a pipelineable and substantially upgraded syncrude from a heavy crude oil characterized by an API gravity of less than 20 wherein 10 to 30 wt% of said crude oil is burned to provide thermal energy to produce said heavy crude oil, the improvement characterized by;

(a) thermally treating in a reactor in the absence of added hydrogen gas at least the 650° F.+ fraction of the heavy crude oil under conditions of outlet temperature, time and reactor outlet pressure such that said oil is subjected to an equivalent residence time (at 800° F.) of 2000 to about 20,000 ERT seconds whereby forming a separable liquid/liquid mixture of thermal syncrude and asphalt phases, said asphalt phase being characterized by a higher specific gravity than said syncrude phase, and wherein said thermal treatment severity is sufficient to form a liquid asphalt phase equal to 10 to 40 weight percent of said heavy crude oil;

(b) maintaining said mixture of thermal syncrude and asphalt phases in a settler under conditions effective to induce liquid/liquid separation solely by gravity of said syncrude phase and said asphalt phase, said conditions including a temperature of 150 to about 950 F. and a time of 0.05 to about 1.0 hours; and, (c) recovering said syncrude phase; and, (d) recovering and burning said asphalt phase whereby providing thermal energy to produce said heavy crude oil.

2. The process described in claim 1 wherein said thermal treatment and said gravity separation are conducted in different vessels.

3. The process described in claim 1 wherein said thermal treatment and said gravity separation are conducted in the same vessel.

4. The process described in claim 1 wherein said outlet temperature is about 750° to about 950° F., said treatment time is about 0.1 to about 3.0 hours, and said reactor outlet pressure is 50 to about 2000 psig.

5. The process described in claim 1 wherein said outlet temperature is 750° to 850° F., said time is 0.5 to 1.0 hours, and said reactor outlet pressure is 50 to 1000 psig.

6. The process described in claim 1 including the step of centrifuging said syncrude phase recovered in step (c) and combining the resulting sediment with said asphalt phase recovered in step (c).

7. The process described in claim 1 wherein said syncrude phase resulting from said thermal treatment comprises a light naphtha portion and including the step of recycling at least a portion of the light naphtha contained in said syncrude recovered in step (c) and recycling the naphtha to step (b).

8. The process described in claim 1 wherein said amount is also sufficient to provide the thermal energy required to produce said heavy crude oil.

9. The process described in claim 1 wherein the severity of said thermal treating step is adjusted to provide sufficient asphalt phase to satisfy the thermal requirement for producing said heavy crude oil.

* * * * *